US005833231A

United States Patent [19]

Schreiner

[11] Patent Number: 5,833,231

[45] Date of Patent: Nov. 10, 1998

[54] APPARATUS FOR CONTROLLING THE TRANSFER OF SHEET LAYERS

[75] Inventor: Max Schreiner, Heiningen, Germany

[73] Assignee: bielomataik Leuze GmbH & Co., Germany

[21] Appl. No.: 614,641

[22] Filed: Mar. 13, 1996

[30] Foreign Application Priority Data

Mar. 22, 1995 [DE] Germany ..... 195 10 364.5

[51] Int. Cl.[6] ..... B65H 29/24

[52] U.S. Cl. ..... 271/197; 271/183; 271/196; 271/276; 271/96

[58] Field of Search ..... 271/69, 197, 196, 271/276, 108, 96, 183, 216, 151, 251

[56] References Cited

U.S. PATENT DOCUMENTS

| | | | |
|---|---|---|---|
| 3,334,896 | 8/1967 | Mullin | 271/74 |
| 3,495,492 | 2/1970 | Gerber et al. . | |
| 3,595,400 | 7/1971 | Peterson | 210/327 |
| 3,659,839 | 5/1972 | Baucke . | |
| 3,684,277 | 8/1972 | Buschmann | 271/46 |
| 4,173,301 | 11/1979 | Turini et al. . | |
| 4,273,324 | 6/1981 | Philipp | 271/183 |
| 4,973,039 | 11/1990 | Jeske et al. . | |
| 5,366,214 | 11/1994 | Sato | 271/100 |

FOREIGN PATENT DOCUMENTS 564322 9/1944 United Kingdom .

*Primary Examiner*—William E. Terrell
*Assistant Examiner*—Patrick Mackey
*Attorney, Agent, or Firm*—Quarles & Brady

[57] ABSTRACT

For each displaceable closing member (19) for controlling and scaling sheet layers (2, 2'), the pneumatic control (17) has in a control surface (26) two control openings (23), between which is formed an additional sliding surface (40) for the graphite closing member (19). Individual closing members (20) are used for the constant position fixing of the control (17) and, facing the openings (23, 24), the closing members (19, 20) slide on a sieve (19), so that limited fault susceptibility occurs at high working speeds.

26 Claims, 4 Drawing Sheets

Figure 1:
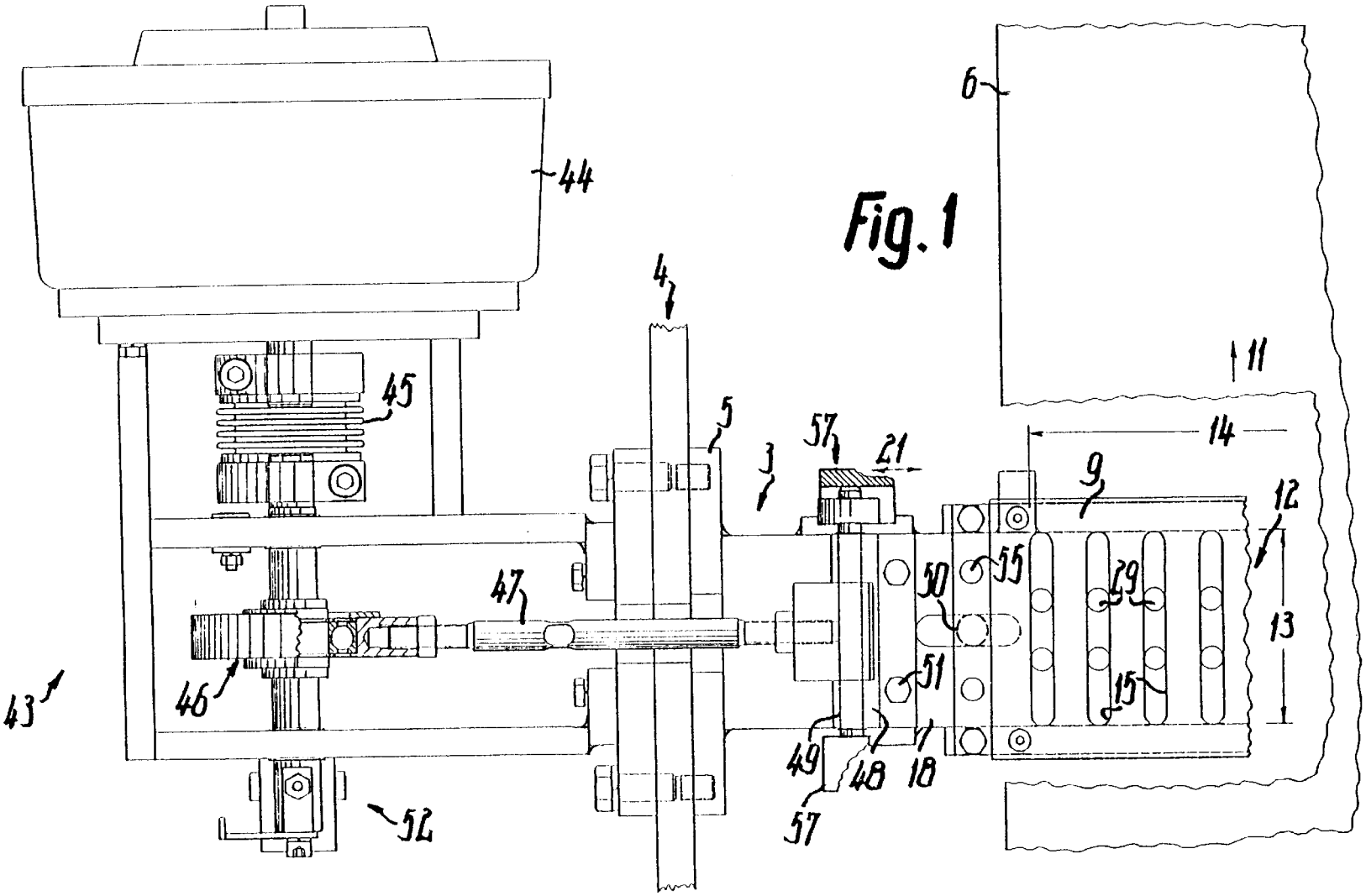

9
15
16
17
18
19
20
21
22
23
24
25
26
29
36
37
38
40

APPARATUS FOR CONTROLLING THE TRANSFER OF SHEET LAYERS

BACKGROUND OF THE INVENTION

The invention relates to an apparatus with which are processed webs travelling in a longitudinal direction, individual sheet layers, sheet layer stacks, etc., e.g. can be conveyed in precisely controlled manner. Thus, successive sheet layers can be transferred into a reciprocal relative movement, e.g. rapidly moving following sheet layers can be delayed and overlapped with slowly leading sheet layers in order to subsequently form from said sheet layers edge-flush stacks. The sheet layers can be made from substrate material, e.g. paper or can be formed by film-like, flat and bending-flexible layers.

For the processing or working of sheet layers use is appropriately made of fluid or pneumatic controls, which allow a very protective treatment, e.g. fixing or retaining of the sheet layers by differential pressure. The sheet layer can be sucked against a fluid-permeable bearing means or surface and simultaneously conveyed by the movement of the latter. The fluid flow through the bearing means or the like is controllable by constricting or tight closure and widening or opening of a single or a plurality of passages, which simultaneously act on the sheet layer. Control takes place by means of a closing member, which is movable with respect to the passage for modifying the passage cross-sections, e.g. in the manner of a slide valve roughly parallel and/or transversely to the sheet layer plane. To ensure a reliable control, the closing member is appropriately smaller than the working field provided for engaging the sheet layer, so that e.g. transversely and/or parallel to the control stroke or lift, several equally large, juxtaposed closing members would exist with a spacing corresponding to approximately half the width of the individual closing member, which controls a single passage.

OBJECTS OF THE INVENTION

An object of the invention is to provide an apparatus avoiding the disadvantages of known constructions or leading to advantages of the indicated type and which in particular, in the case of simple and compact construction, has a high control precision or a long service life.

SUMMARY OF THE INVENTION

According to the invention in axial view the individual passage diverges from a shape as would result from a single circular opening. Thus, in this view, within a very narrow limiting circle located on the outer limits of the passage there is at least one additional surface, which at least partly can be transversely displaced slightly with respect to the control surface or the like traversed by the passage or can be located in the plane of this control surface. The additional surface is partly or completely in one piece with the limit or boundary of one or more passage openings and/or the control surface outwardly connected to the limiting or enveloping circle. The passage can be formed by a single non-circular opening or by two or more adjacent openings, whose internal spacing is smaller than their width. As a result of this additional surface the closing member is reliably guided directly following onto the boundary of the passage opening and it is ensured that the uninterrupted, sharp boundary edges of this opening do not close too rapidly the closing member sliding in pressure-tight manner on the control surface. Through this or by other measures the closing member can be pressed relatively strongly against the control surface and its lift or stroke can be max 0.9 or 0.8 times its width or diameter. The control movement can be rotary and/or reciprocating and the control stroke is the path between two successive stoppages, e.g. an open position and an immediately following closed position or vice versa.

The control stroke can be smaller than half the outside width of the closing member or roughly the same as the width of said enveloping circle or at the most ½ or a ⅓ greater than the width of the individual passage opening. All the said widths can be the minimum, maximum or an average width. The stroke or lift can at the most be a ½ or a ⅓ greater than the extension of the individual passage in the lift or stroke direction. Appropriately said extension is smaller than the extension of the passage at right angles to the lift direction. The greatest width of the closing member or its closing surface transversely or at right angles to the lift direction can be smaller than 1.8 or 1.5 times the corresponding passage extension. The closing surface also need not completely free the passage in the open position and instead in an axial view can project slightly into one or more passage openings. The additional surface advantageously passes with one or both ends or over its entire length over the smallest extension of the passage in uninterrupted or one-piece manner up to the connection to the control surface in the vicinity of the enveloping circle and forms a portion of the through, one-piece control surface.

Independently of this the described and other effects can also be obtained in that the closing member is positioned eccentrically with respect to one or more associated passage openings in the closed position. For example, in each position of the closing member a common axial plane transverse or at right angles to the lift direction of at least two to all the associated passage openings can be displaced with respect to an axial plane of the closing member parallel thereto in the lift direction.

Independently of this means can be provided, so that within the working field or the entire control surface, as well as in an area set back with respect to the sheet layer plane on the control arrangement is exerted a force directed transversely to said plane, which is higher than the flow friction and appropriately acts adjacent to or outside the opening and closing member. The force advantageously acts on a control slide valve, which transfers the lift movement to the closing member and engages in axially freely movable manner therein. For obtaining this force no spring is required, if it can be produced by fluid force, particularly by the indicated fluid. In addition to the opening and closing member at least one further closing member can be provided, but in each of the said lift positions or in each intermediate position closes an associated passage in a substantially tight manner and is therefore constantly pressed or sucked against the control surface. If this control member is firmly connected to the control slide valve or the like in the loading direction by adhesion, such as pressing, sticking and/or the like or by stop action, then it loads the slide valve constantly away from the sheet layer plane. Therefore the control arrangement or the closing member can be held transversely to its plane constantly in a precisely defined position or spacing position and can be relatively thin. For example, the thickness of the closing member can be less than ⅓ of its outside width, e.g. approximately only a ¼ thereof.

Independently thereof, between the sheet layer plane and a pressure or vacuum source directly connected to the passages is appropriately provided at least one narrow-mesh sieve or screen which avoids dust or similar particles such as sheet layer particles being sucked into the control arrangement or the pressure source. The sieve is appropriately set back with respect to the bearing means plane and with respect to the pressure source, the passage and/or the closing member is outwardly displaced. It can be formed by a perforated plate with a hole width of less than 2 mm.

Also independently thereof for fluid guidance is appropriately provided at least one flow opening, which by a partial or complete overlap simultaneously directly communicated with two or more connecting openings. The flow opening is appropriately closer to the sheet layer plane than the connecting opening and can be separated from the sheet layer plane only by a thin, fluid-permeable surface body. In addition, the connecting opening can communicate through the sieve with the flow opening. Thus, in the case of a simple construction, there is a very strong fluid action on the sheet layer over an area which is relatively large in the conveying direction.

Quite independently of this at least one closing member or at least its closing surface or the sliding surface remote therefrom can be made from a self-lubricating material, such as graphite or a particularly suitable, continuously lubricant-supplying plastic. Advantageously the closing member is constructed in one piece over its entire extension, e.g. as a through, cylindrical disk or as an end disk with a widened collar at a single end of a shank portion, which can engage in the control slide valve or some other appropriate control member.

BRIEF FIGURE DESCRIPTION

These and further features can be gathered from the claims, description and drawings and the individual features, both singly and in the form of sub-combinations, can be implemented in an embodiment of the invention and in other fields and can represent advantageous, independently protectable constructions for which protection is hereby claimed. An embodiment of the invention is described in greater detail hereinafter relative to the drawings, wherein show:

FIG. 1 An apparatus according to the invention in detail plan view.

Figures 2, 6:
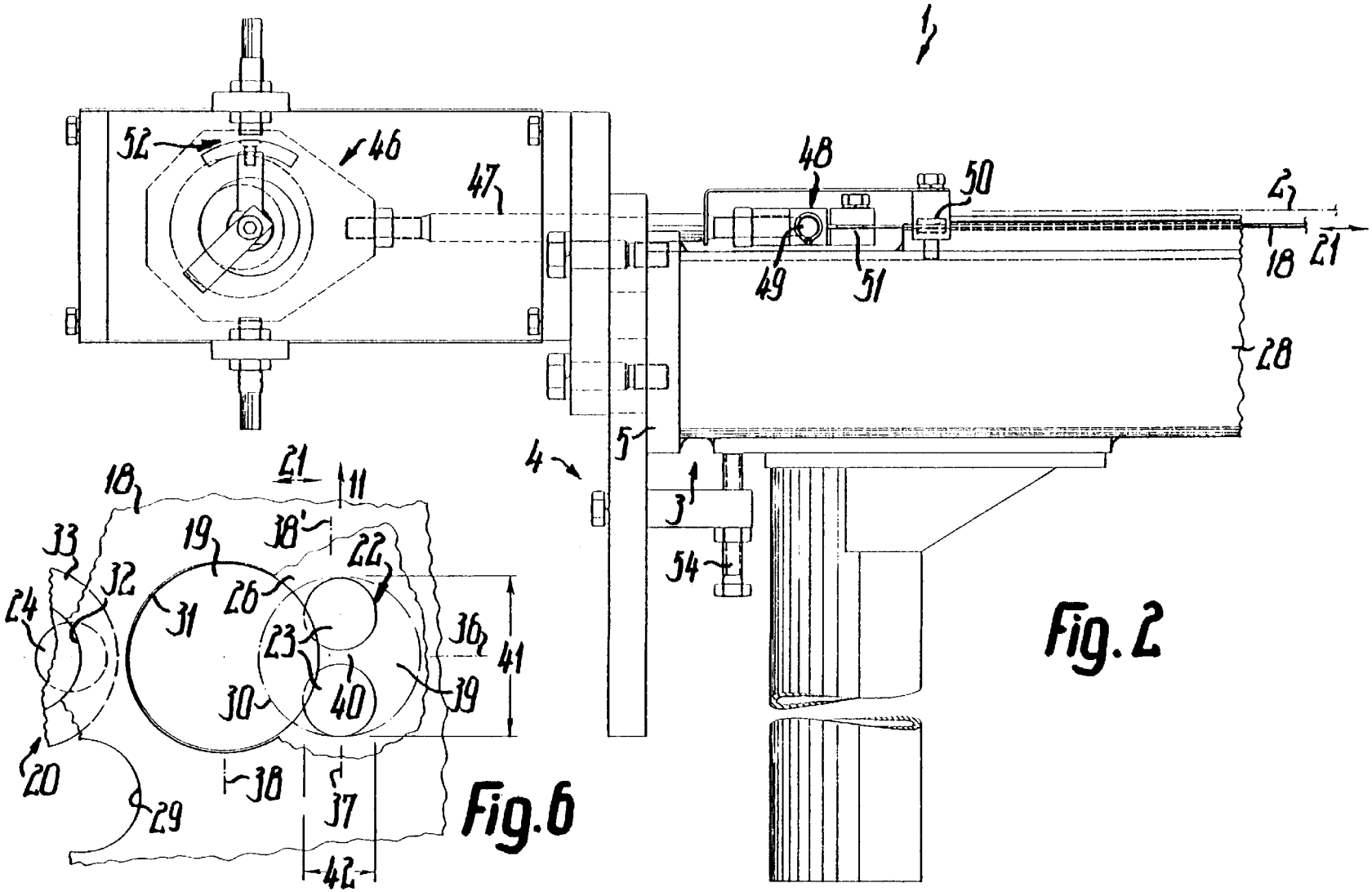

FIG. 2 The apparatus of FIG. 1 in side view.

Figure 3:
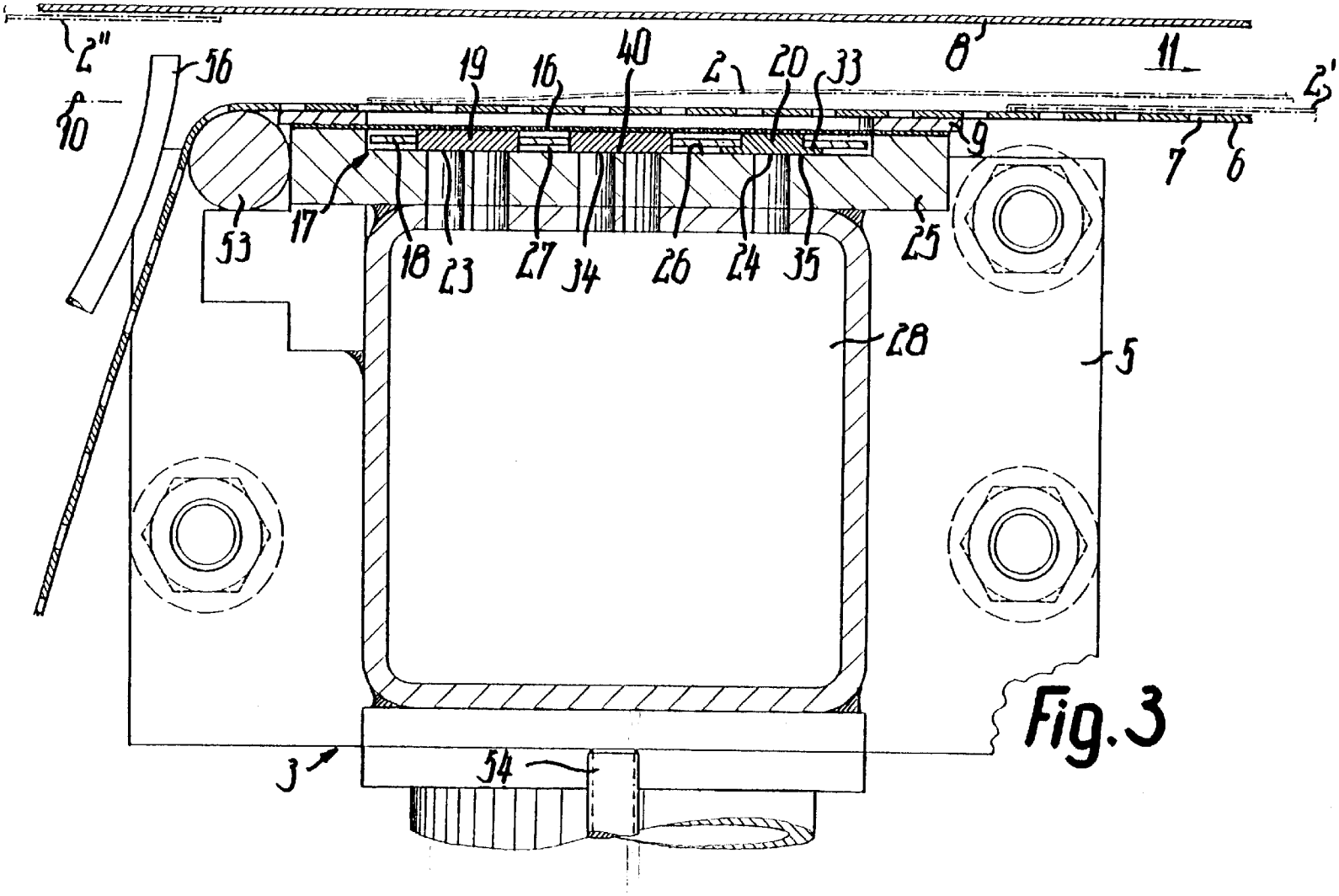

FIG. 3 A section through the apparatus of FIG. 2 on a larger scale.

Figures 4, 5:
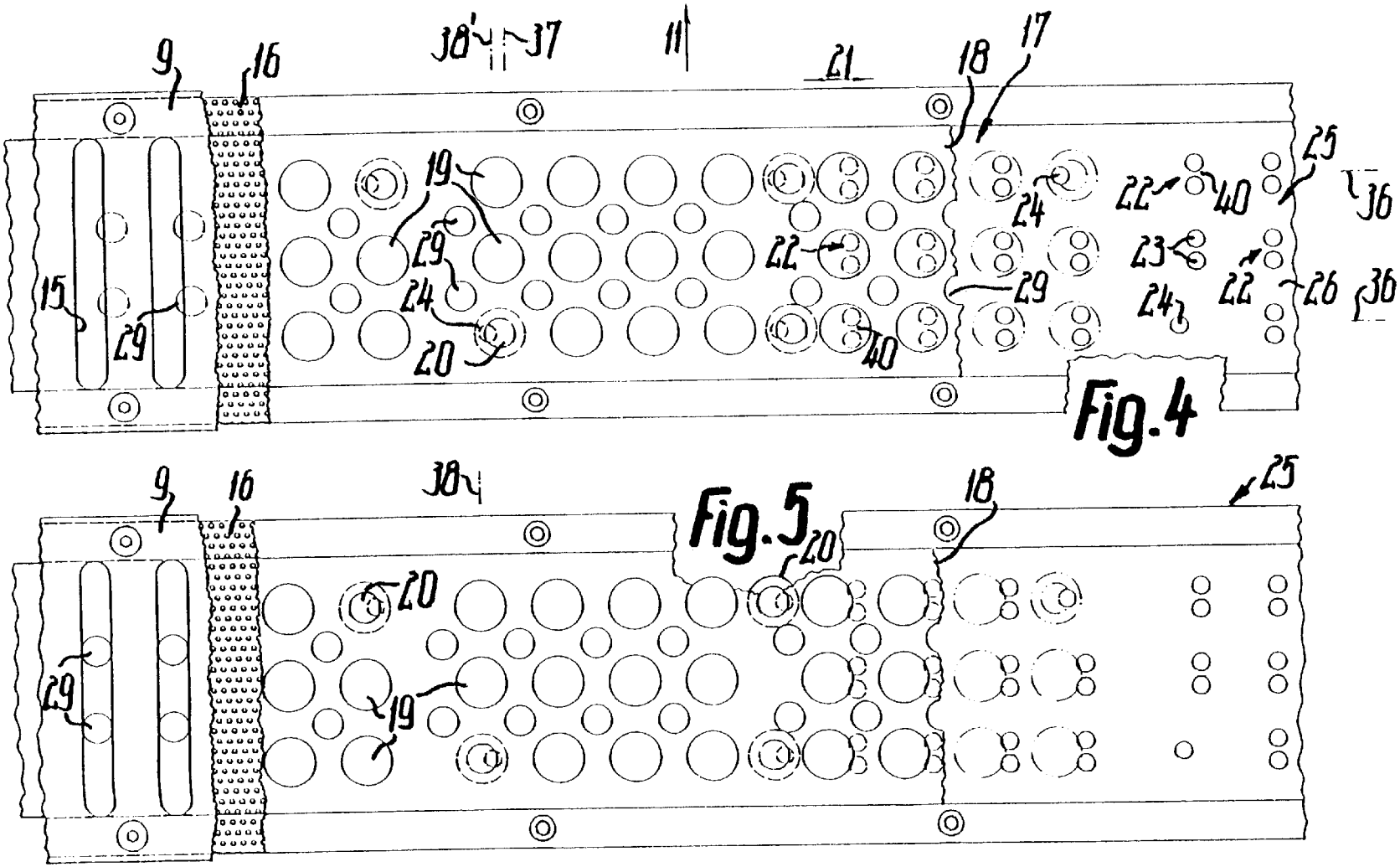

FIG. 4 A detail of FIG. 1 in plan view and in the closed position.

FIG. 5 The arrangement of FIG. 4 in the open position.

FIG. 6 A larger scale detail of FIG. 5.

The apparatus 1 is used for the intermediate arrangement in a paper processing machine, in which a paper web or several successive paper webs are drawn from reels and then successively cross-cut into several widths so as to form longitudinal, as well as juxtaposed and succeeding sheet layers with a cutting speed of up to 500 cuts per minute and then successive sheet layers are brought to a spacing of approximately 60 to 80 mm. In this way the sheet layers 2 are supplied to the apparatus 1 from one to max ten flush-succeeding, equally large individual sheets and in said apparatus, following partial overlap of the more slowly leading sheet layer 2' solely by direct engagement on the trailing edge suddenly delayed to the slower travel speed, which leads to a scale flow. During the delay a further brake mechanism, e.g. constructed to DE-OS 38 12 685, can act on the leading sheet layer end. The sheet layers are then moved together flush to larger stacks, oriented and packed in stack form. Apparatuses with the inventive features can also be used for other purposes.

The machine has a frame 4 supported on a floor foundation and on whose lateral side plates located on either side of the working width the apparatus 1 with lateral plates 5 of a base 3 is so rigidly fixed that the complete working width over several meters is freely covered without any further support. Upstream, downstream and over the apparatus 1 extends a cross-sectionally planar or horizontal, plate-like, thin bearing means 6, e.g. a conveyor belt running round the apparatus. The planar, horizontal bearing means 6 is provided with a grid perforation system 7, not shown in FIG. 1, through which the rear end of the sheet layer 2 can be firmly sucked against the bearing surface. Said upper bearing surface is spaced from and parallel to a counter-securing means 8, e.g. a more rapidly rotating conveyor belt, on which the incoming sheet layers 2, 2" are guided and then transferred by transverse movement to the belt 6. The belt 6 is firmly slidingly supported on the top of a planar, plate-like support body 9 and is consequently non-resiliently supported transversely to the bearing or sheet layer plane 10 during its movement in the conveying direction 11.

The apparatus 1 defines a working field 12 extending the working width 14 and its working length 13 approximately extending over the support body 9 is significantly smaller. In the support body 9 in spaced manner between its longitudinal edges and extending over the working length 13 and parallel to the direction 11 there are elongated flow openings 15 as passages and uniformly juxtaposed over the entire working width 14 and which are covered by the belt 6 and passed over by the perforation system 7. On the bottom of the body 9 engages a one-piece, through perforated plate extending over the entire working field 12 in the form of a sieve 16 and it completely covers a flat, thin fluid control 17 or a control chamber 27 receiving the latter. The control 17 has a control member 18 contact-free relative to the chamber walls, e.g. a through, plate-like slide, which as a cage is traversed by equally long, graphite closing members 19, 20 projecting to either side and moves the latter backwards and forwards for control purposes at right angles to the conveying direction 11 in a lift direction 21.

Facing the bearing means 6 the bottom of the chamber 27 is traversed over the entire working field uniformly and/or non-uniformly by passages 22, 24, whereof the passages 22 during the control movement with the members 19 are partly or completely opened and completely closed, whereas the passage 24 remains constantly closed through a single closing member 20. Each passage 22 consists of two or more directly adjacent passage openings 23 controlled by a single closing member 19. Each passage 24 consists of a single opening of the same width as the opening 23. The openings 23, 24 are formed by the passages of channels or bores in the bottom or a control surface 26 of the chamber 27 and bounded in sharp-edged manner with a flank angle of approximately 90°. The channels which are at right angles to the plane 10 traverse a plate-like body 25 bounding with a raised edge the chamber 27 over the entire circumference and forming the lowered, planar control surface 26 and between its edge and the support body 9 the sieve 16 is fixed in non-destructive, interchangeable manner with its edge.

Between the sieve 16 and the control surface 26, on their facing sides slide the closing members 19, 20 with through, planar, end faces and with respect to which the slide 18 is completely contact-free, is bounded the chamber 27 flatter than the body 25 and higher than the parts 16, 18. The other ends of the channels issue into a fluid or vacuum chamber 28, which can be formed by a one-piece tubular profile tightly fixed with the end faces to the side plates 5 and having a planar wall traversed by the channels for the fixing of the body 25. The tubular profile simultaneously forms the single or main carrier of the apparatus 1 between the side plates 5 and is connectable by a connecting piece on its underside to a vacuum source. Adjacent to the closing members 19, 20 or between the latter the slide 18 is traversed by connecting openings 29 uniformly distributed over the field 12 and which constantly keep in communicating fluid connection parts of the chamber 27 adjacent on the one hand to the sieve 16 and on the other to the control surface 26. The sieve openings are smaller and/or shorter than the openings 7, 15, 23, 24, 29.

As can in particular be gathered from FIG. 6, the openings 29 have the same shape or width as the openings 32 for the closing members 20, are wider than the openings 23 and narrower than the openings 31 for the closing members 19. Each closing member 20 traverses with a cylindrical shank the opening 32 in the slide 18, can slide with the end face of the shank on the sieve 16 or can have a clearance and forms on the remote side of the slide 18 with a diameter-widened collar 33 between the slide 18 and the control surface 26 a spacing member, whose end or opposite surface 35 slides on the control surface 26 in such a way that in each lift position the openings 24 remain closed and through the same the closing member 20 with the slide 18 is drawn against the control surface 26. Approximately tangentially adjacent to the opposite surface 35 can be provided an opening 29.

Each through, cylindrical, disk-like, flat closing member 19, which has the same outside width as the spacing member 33, slides with a correspondingly constructed opposite surface 35 on the control surface 26. The equally large openings 23 of each passage 22 are positioned symmetrically on either side of a median plane 36 parallel to the direction 21 and at right angles to the direction 11, as well as in a common axial plane 37 at right angles to the direction 21 or the plane 36 and parallel to the direction 11. Around the circular openings 23 can be placed a very narrow enveloping circle 30, which touches at one point on their remote sides the openings 23. As a function of the number and shape of the openings 23, which can be bounded only or combined circular or linearly, in place of only two touching points there can be several such points or those extending over a partial arc of the enveloping circle 30. The smallest spacing between adjacent openings 23 is smaller than their half width and the associated extension 41 of the passage 32 in the direction 11 is the same as the diameter of the enveloping circle 30. The extension 42 in direction 21 is much smaller, namely at the most half as large. Thus, over the circumference adjacent to the enveloping circle 30 is created by the control surface 26 an additional surface 40 equiplanar thereto, in one piece and bounding the openings 23 over most of the circumference thereof and whose extension in the directions 11, 21 is substantially the same as the extension 41. The additional surface 40 is narrowest between the openings 23 and then becomes progressively wider towards both ends 39 relative to the direction 21 and extends up to the touching points, so that on the one hand it is only bounded by the openings 23 and on the other by the enveloping circle 30. The surface 40 can be symmetrical to the planes 36, 37.

The closing member 19 which is about three times thicker than the slide 18 traverses the opening 31 with a radial clearance of a few tenths of a millimetre, so that jamming is excluded and there is always a free, axial mobility. In the open position according to FIG. 6 the closing member 19 covers the openings 23 of the single passage 22 controlled by it by less than ¼ or a ⅐ of the opening width, the central axis of the closing member 19 being located in the plane 36 and in a plane 38 at right angles to or parallel to the plane 37. When the passage 22 is closed the closing member 19 is in the axial plane 38', which is arranged in spaced manner between the planes 37, 38, but is closer to the plane 37. Therefore the total travel between the planes 38, 38' is very short. In both positions the opening 24 is eccentric to the associated closing member 20. The spacing member 33 can only have a gap spacing from the adjacent, closing member 19 and like the associated opening 24 can be in the plane 36.

As shown in FIGS. 4 and 5, in succession in direction 11 and immediately adjacent to the boundaries of the working length 13, there are two rows of closing members 19, 20 distributed over the working width 14 and between adjacent closing members 20 there are in each case several closing members 19. Between said rows there is a single row or several rows in uniformly distributed manner, which appropriately only have closing members 19. Adjacent closing members 19, 20 of all the rows are in a common plane 38 or 38', but in each of these planes there can only be a single closing member 20 or in such a plane there can be two closing members 20 and no closing member 19. Between adjacent closing member rows are parallel rows with the openings 29, but they are displaced with respect to the adjacent closing members 19, 20 in the direction 21. The inside spacing between adjacent closing members 19, 20 in each of the directions 11, 12 can be at the most as large or smaller than the width of the openings 29. The passages 22, 24 are provided in accordance with the closing member rows in the control surface 26.

In the closed position according to FIG. 4 the openings 15 cover the openings 29 only over most of their width and for illustration purposes the sieve 16 located between said openings is not shown in the vicinity of the support member 9. In the open position according to FIG. 5 the openings 29 are congruent to the openings 15 and have the same width. However, the width of the perforation system 7 is smaller, e.g. by approximately ⅙. The members 20 can be provided solely as guide members without covering an opening 24. This in particular applies for those members 19, which are in a common plane parallel to the direction 11. Closing members 20 can also be provided for controlling the passages 22.

The slide 18 is driven at one end by a control or a drive 43, which laterally outside the side plate 4 carries a motor 44 with an axis or shaft at right angles to the direction 21 or parallel to the direction 11. By means of a torsionally stiff, but radially elastically compensating bellows coupling 45, the motor shaft drives an eccentric 46 equiaxial thereto and whose external armature is connected by means of a rod-like ram 47 to the slide 18. The two ends of the ram 47 are fixed with oppositely directed thread pitches on the external armature and on the slide 18, so that the spacing between the eccentric axis and the slide 18 can be adjusted. The parts 44 to 46 are fixed or mounted on a bracket, which freely carried is braced jointly with the side plate 5 with respect to the side plate 4, so that the parts 44 to 46 are located laterally outside the side plate 4, which is traversed by the ram 47.

By means of a joint 49, the actuating end of the ram 47 is connected in articulated manner to a head 48 about an axis at right angles to the direction 21 or roughly in the plane of slide 18 and on which the end of the slide 18 is fixed in easily detachable manner with a clamping means 51. Immediately adjacent to the working width 14, a low-friction guide 50 is provided for the lateral guidance of the slide 18 in spaced manner between its longitudinal edges, so that the latter can have a gap spacing permanently with respect to the facing circumferential boundaries of the chamber 27. The slide 18 is traversed by a guide opening elongated in direction 21 and on whose parallel longitudinal edges can engage in almost transverse clearance-free manner the outer circumference of the outer ring of an antifriction bearing as the guide member 50 and is appropriately located in the centre of the working length 13. A corresponding arrangement can be provided at the other end of the slide 18. The end of the slide 18 has axial clearance transversely to the plane 10 facing the guide 50. However, each projecting end can be positively and adjustably guided transversely to the plane 10 with a guide 57, e.g. with antifriction bearings located on the ends of the bolt 49 and whose outer rings run in longitudinal grooves.

Between individual control strokes the motor 44 can be cyclically driven with different speeds, e.g. from inching to highly accelerated speeds, e.g. in the form of a disk armature motor. For the constant, dynamic determination of the rotary position of the drive 43 it is appropriate to have on the eccentric shaft a path detection means 52, e.g. a contact-free functioning, inductive or capacitive means. The latter gives the rotary position to an electronic control for the drive 43. The motor can also be a three-phase servomotor, which directly incorporates a path detection means, which is appropriately adjustable in this case.

The entire base 3, including one to all the deflections 53 of the belt 6 is continuously positionally adjusted with respect to the frame 4 about its longitudinal axis directed transversely to the direction 11 and also separately as regards height at each end, so that the plane 10 can be positionally adjusted with respect to the belt 8. The inlet-side deflection 53, which is appropriately a fixed sliding rod for the belt 6, is located on the base 3 immediately adjacent to the support body 9. The belt 6 is inclined with respect to the belt 8 towards the deflection means 53, where it is deflected into the plane 10 and immediately supplied to the stiff support 9. For this adjustment on either side of the longitudinal axis of the base 3 and on its two ends can engage separate adjusting spindles 54. For adjusting the drive 43, 46, 47 means 55 are provided with which the control 17 or 18 can be fixed in clearance-free manner in a precise lift position, e.g. the widest open position. On either side of the guide 50 the adjusting means 55 has centering or insertion openings for a bolt, with which outside the field 12 through bores of the slide 18 are aligned in direction 25. In the adjusting position these bores coincide with the centering bores, so that with a bolt inserted from the plane 10 in each centering bore fixing can take place.

In operation the sheet layer 2, 2' engages on the underside of the belt 8 in spaced manner above the plane 10 in the direction 11 over the deflection means 53. It is pressed by means 56, e.g. air passing out of a nozzle arrangement and/or a guide member in spaced manner with respect to the belt 6 against the belt 8. The front end of the sheet layer 2, 2' runs over the entire field 12 and sinks in overlapping manner only over the rear end of the leading sheet layer 2' outside the field 12. As soon as the rear end of the sheet layer 2 coincides with the field 12, the control 17 opens and this end is suddenly drawn against the belt 6 and fixed thereto, because the perforation system 7 sucks air into the constantly evacuated chamber 28. The sheet layer 2 is consequently suddenly delayed to the slower speed of the belt 6. Simultaneously with these actions the belt 6 continuously conveys on the sheet layers 2, 2' for further processing. All the components 3, 5, 9, 16, 17, 18, 25, separately or jointly, can be provided in the bath with a wear-reducing, very hard coating, e.g. of hard nickel, which is applied with a thickness of a few hundredths of a millimetre.

Each of the apparatus components can be provided once or many times. In addition, all the indicated characteristics, also position determinations, orientations and size ratios can be as described or diverged therefrom, so as to only be provided approximately or substantially.

I claim:

1. An apparatus for controlling transfer of sheet layers comprising:

an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member capable of completely covering said control passage, including said at least two passage openings, said control member being displaceable along said control surface to perform a control motion; and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, wherein means are provided for stressing said control face in contact with said control surface with an operating stress and without stressing said positioning member in contact with said control surface with said operating stress around said control passage, said control member being displaceable with respect to said positioning sections in an adapting direction oriented transverse to said control surface and to said control face, said control face displaceably engaging said control surface; an addendum circle being defined which is the most narrow circle which completely covers said control passage on said control surface; in plan view on said control surface an additional surface section of said control surface being provided within said addendum circle; said passage opening traversing said control surface and being areally smaller than said addendum circle.

2. The apparatus according to claim 1, wherein said control face is provided for varying said passage cross section of only a single control passage, said control member being a pellet separate from said positioning member and at least partly traversing said positioning member within said positioning sections, said positioning sections being an inner circumferential face of a hole traversing said positioning member and circumferentially slidably engaging said control member.

3. The apparatus according to claim 2, wherein an operating field is provided for being covered by the sheet layers, said operating field covering said control surface when seen in plan view on said control surface, said operating field defining transverse field extensions including a field width extension and a field length extension oriented perpendicular to said field width extension, said control surface extending only over a partial extension of at least one of said field extensions and being displaceable over a control stroke oriented parallel to said control surface, said control stroke defining both said control motion and said positioning direction, said control face operationally sliding on said control surface associated surface of said positioning sections, said associated surface opposing said control surface, said operating field defining a layer plane of said sheet layers substantially parallel to said control surface, said positioning sections juxtaposedly surrounding said control member when seen transverse to said control surface and said control face, said positioning sections radially limiting displacement of said control member with respect to said positioning member.

4. The apparatus according to claim 2, wherein said additional surface section is oriented parallel to said control surface, and coplanar with said control surface, said additional surface section continuously connecting to said control surface at said addendum circle.

5. The apparatus according to claim 2, wherein said additional surface section is oblong and has varying width extensions, within said addendum circle said additional surface section being only traversed by said control passage entirely located within said addendum circle, said additional surface section being entirely coplanar with said control surface and directly connecting to said control surface at said addendum circle.

6. The apparatus according to claim 2, wherein said positioning member and said control member are commonly displaceable in said positioning direction, parallel to said positioning direction and within said addendum circle, said control passage having a smaller passage extension than transverse to said control direction, said additional surface section extending radially toward said circle center.

7. The apparatus according to claim 2, wherein at said addendum circle said additional surface section includes at least one section end uninterruptedly and continuously connecting flush to said control surface peripherally connecting to said addendum circle, said outermost peripheral boundary being entirely actuated.

8. An apparatus for controlling transfer of sheet layers comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, wherein said control passage includes two juxtaposed separate passage openings in a control surface, a control member commonly varying only said passage cross-section of said passage openings, said control member being a component separate from said positioning member and slidably displaceable with respect to said positioning member in an adapting direction oriented transverse to said control surface, said control member being circumferentially enclosed by said positioning sections defining an orifice, said orifice traversing said positioning member.

9. The apparatus according to claim 2, wherein said additional surface section is bounded by at least one section flank, said section flank being actuated and defining a flank radius, said circle radius at least partly diverging from said flank radius, said section flank at least partly being concave, transverse to said section flank said additional surface section defining a section width extension, said section width extension varying along said section flank, at least two of said control passages and at least two of said control members being juxtaposed transverse to said control motion and parallel to said control surface.

10. An apparatus for controlling transfer of sheet layers comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable alone said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, wherein said control member defines an operationally stationary closing end position for entirely closing said control passage, said control passage including at least two passage openings in said control surface, said control member being positioned eccentric with respect to said passage openings in the closing end position, said control member being a component separate from said positioning member and transversely slidably traversing said positioning member.

11. An apparatus for controlling transfer of sheet layers, said apparatus comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, said control member having a control face, wherein from a most opened position and a most closed position of said control member a control motion defines a maximum stroke path, parallel to said control motion said control face of said control member defining a maximum face width extension, said maximum stroke path being smaller than 0.7 to 0.5 times said maximum face width extension, in said opened position said control face leaving a corresponding control passage substantially open, said control member being a component separate from said positioning member and transversely slidably traversing said positioning member.

12. An apparatus for controlling transfer of sheet layers comprising an apparatus base including a control surface for controlling motion of the sheet layers;

a control passage penetrating said control surface and bounded by an outermost peripheral boundary of said control surface, said control passage including a passage opening and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, said control member having a central surface, a control passage penetrating said control surface, and having at least two passage openings, wherein median planes of said passage opening are defined and include a first median plane parallel to said control motion and a second median plane transverse to said control motion, in a closed stationary position said control member being oriented symmetrical to at least one of said median planes, in said closed stationary position said control member entirely covering and closing said passage openings, said control member being displaceable with respect to positioning sections in an adapting direction oriented transverse to said control surface, said control face displaceably engaging said control surface.

13. The apparatus according to claim 1, wherein in substantially all positions along said control motion said control member is oriented substantially symmetrical to a middle plane of the said additional surface section, said middle plane being oriented parallel to said control motion, transverse to said control surface said control member being thicker than said positioning sections, said control member being a component separate from said positioning sections circumferentially displaceably engaging said control member.

14. An apparatus for controlling transfer of sheet layers, wherein the apparatus comprises an appraratus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, means for substantially permanently forcing a positioning member transverse to a control surface toward an abutted position, a positioning section being transversely spaced from said control surface, for displacing a control member with respect to said positioning member in an adapting direction oriented transverse to said control surface, said positioning section directly displaceably surrounding said control member, when seen transverse to said control surface an abutment face being provided within said control surface, when in said abutted position said positioning member abutting against said abutment face, said control surface being planar.

15. The apparatus according to claim 14, wherein said forcing means include fluid pressure means for loading said positioning member toward said control surface and said abutment face when said control member is opened, said abutment face being transversely spaced from said control surface.

16. The apparatus according to claim 14, wherein said control surface is traversed by at least one suction stressing port substantially permanently entirely closed by a loading surface, said loading surface rigidly connecting to said positioning member codirectional with the stressing direction, when in said abutted position said loading surface directly abutting against said control surface.

17. The apparatus according to claim 1, wherein said control member includes a closing member permanently entirely covering said control passage and spacing said positioning member from said control surface by abutting means, when seen transverse to said control surface said abutting means being located within said control surface, said control surface being planar.

18. The apparatus according to claim 1, wherein at least two said control members and at least two said control passages are located side by side transverse to said control motion, three coordinate directions being defined and include a first direction parallel to said control motion, a second direction perpendicular to said control motion but parallel to said control surface and a third direction perpendicular to said control surface, with respect to said positioning member said control member having motion play parallel to said three coordinate directions.

19. An apparatus for controlling transfer of sheet layers comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, said control passage penetrating a control surface and having a passage opening, wherein said control passage and said passage opening include a plurality of suction ports in said control surface, an operating face for directly supporting the sheet layers covering said control surface, said control passage being linear and defining remote passage ends including first ends adjacent said operating field, a dust sieve permeable to a fluid covering at least one of said passage ends.

20. The apparatus according to claim 19, wherein said dust sieve has sieve openings smaller than said passage cross-section, said dust sieve being located directly adjacent to said control member and opposing said control surface.

21. An apparatus for controlling transfer of sheet layers, comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion, and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, said support member is included for directly supporting the sheet layers, a cover member covering a control member, and a positioning member, between said positioning member and said support member, said cover member being traversed by at least one transverse flow opening for passing a fluid, said positioning member being traversed by connecting openings, when said control member is opened said flow opening positionally coinciding with at least two of said connecting openings, said connecting openings and said control member being juxtaposed.

22. The apparatus according to claim 21, wherein said two connecting openings are juxtaposed transverse to said control motion, said support member being provided for conveyingly engaging the sheet layers and permeable to the fluid, said support member supporting against said cover member.

23. The apparatus according to claim 21, wherein on a side of said cover member opposing said control member a dust sieve is provided and covers said flow opening.

24. The apparatus according to claim 21, wherein in plan view on said cover member said flow opening is oblong.

25. An apparatus for controlling transfer of sheet layers, said apparatus comprising an apparatus base including a control surface for controlling motion of the sheet layers;

a control passage penetrating said control surface and bounded by an outermost peripheral boundary of said control surface, said control passage including at least two passage openings and defining a passage cross-section for passing a control fluid;

a control member for said control passage, said control member being displaceable along said control surface to perform a control motion; and a positioning member for operationally positioning said control member with respect to said control passage and with respect to a positioning direction, said control member including a control face for varying said passage cross-section for controlling passage of the control fluid through said control passage, said positioning member including positioning sections juxtaposedly surrounding said control member when seen transverse to said positioning direction, said control member having a control face, wherein said control face is made from a material incorporating a lubricant component for lubricating a control surface.

26. The apparatus according to claim 25, wherein said control member includes said material and is made in one part, said material including graphite, and wherein said control member is displaceable with respect to said positioning member transverse to said control face.

* * * * *

UNITED STATES PATENT AND TRADEMARK OFFICE

CERTIFICATE OF CORRECTION

PATENT NO. : 5,833,231
DATED : November 10, 1998
INVENTOR(S) : Schreiner

It is certified that error appears in the above-indentified patent and that said Letters Patent is hereby corrected as shown below:

In Claim 3, column 8, line 67, before "associated" insert --and being smaller than an--.

Claim 9, column 10, line 3, replace "actuated" with --arcuated--.

Signed and Sealed this

Sixteenth Day of November, 1999

*Attest:*

*Attesting Officer*

Q. TODD DICKINSON

*Acting Commissioner of Patents and Trademarks*